US007040602B1

(12) United States Patent
Williams

(10) Patent No.: US 7,040,602 B1
(45) Date of Patent: May 9, 2006

(54) STAKE PULLER

(75) Inventor: Philip Williams, Estacada, OR (US)

(73) Assignee: Wimpy Tools, Inc., Estacada, OR (US)

( * ) Notice: Subject to any disclaimer, the term of this patent is extended or adjusted under 35 U.S.C. 154(b) by 0 days.

(21) Appl. No.: 11/138,810

(22) Filed: May 25, 2005

Related U.S. Application Data

(60) Provisional application No. 60/574,607, filed on May 25, 2004.

(51) Int. Cl.
*E21B 19/00* (2006.01)

(52) U.S. Cl. ..... 254/30

(58) Field of Classification Search ..... 254/30, 254/131
See application file for complete search history.

(56) References Cited

U.S. PATENT DOCUMENTS

| | | | | |
|---|---|---|---|---|
| 2,582,284 A | | 1/1952 | Sarosdy | |
| 4,263,972 A | | 4/1981 | Johnson | |
| 4,454,792 A | | 6/1984 | Burris | |
| 4,671,493 A | | 6/1987 | Ravencroft | |
| 5,022,632 A | * | 6/1991 | Beideck | 254/30 |
| 5,025,867 A | | 6/1991 | Muller | |
| 5,464,192 A | * | 11/1995 | Burnham | 254/30 |
| 5,547,168 A | | 8/1996 | Kelly | |
| 5,566,924 A | | 10/1996 | Shirk | |
| 5,597,151 A | | 1/1997 | Duncan | |
| 5,713,559 A | * | 2/1998 | McClarin et al. | 254/124 |
| 5,833,215 A | * | 11/1998 | Vandenburg | 254/30 |
| 6,302,376 B1 | | 10/2001 | Williams | |
| 6,598,856 B1 | | 7/2003 | Puff et al. | |

* cited by examiner

*Primary Examiner*—Lee D. Wilson
(74) *Attorney, Agent, or Firm*—Kolisch Hartwell, et al.

(57) ABSTRACT

A attachment for a pry bar for pulling up a stake is disclosed, wherein the stake puller includes a coupler attachable to the pry bar and a grip pivotally connected to the coupler on an axis substantially perpendicular to a rotational axis of the pry bar, the grip being adapted to releasably attach to the stake. Other embodiments as described herein.

22 Claims, 3 Drawing Sheets

STAKE PULLER

CROSS REFERENCE TO RELATED APPLICATION

This application claims priority to provisional application Ser. No. 60/574,607 filed May 25, 2004 for STAKE PULLER. The subject matter of the above-identified application is incorporated herein by reference in their entirety for all purposes.

TECHNICAL FIELD

The present invention relates to tools that remove stakes from the ground. More particularly, the invention provides an improved attachment for a pry bar to remove stakes from the ground.

BACKGROUND

Cement, concrete, and other moldable construction materials typically are poured into molds that are defined by forms, which are wooden planks or boards or other materials providing the outline of the mold. While the concrete is poured and drying, the forms are held in place by stakes driven into the ground adjacent the form. The concrete may be poured in large quantities that produce considerable outward pressure on the forms, and thus the stakes are driven deeply into the ground. The stakes and the forms are removed after the concrete has set and significant upward pressure must be exerted on the stakes to remove them. The stakes typically have smooth sides and no head or other partially horizontal structures to accommodate the upward pressure applied by a typical pry bar. Various tools have been devised for pulling up the stakes, but only with complex structures or inefficient modes of operations.

SUMMARY

An attachment for a pry bar to use for pulling up stakes may include a coupling portion to receive the typically wedge-shaped tip of the pry bar. A post may be mounted on the coupling portion and extends in front of the coupling portion. A grip may be mounted on the post to rotate about the post about a channel formed with the grip. The grip typically includes a forward-facing, U-shaped slot for receiving and gripping a stake to be pulled up from the ground. The grip is rotatable, by the channel's rotating on the post, about an axis that is generally perpendicular to the axis of rotation for the pry bar. The grip's rotation may be limited by stops on the grip, post, and/or coupler. When the grip is applied to a stake and a handle of the pry bar is pushed down, drawing the grip upwards, the grip rotates slightly and takes hold of the stake at opposite edges of the sides of the U-shaped slot. As the grip and stake are drawn upward, a recess in the bight of the U-shaped slot provides space to receive the stake, allowing the stake to be maintained deep in the slot.

DETAILED DESCRIPTION

Figure 1:
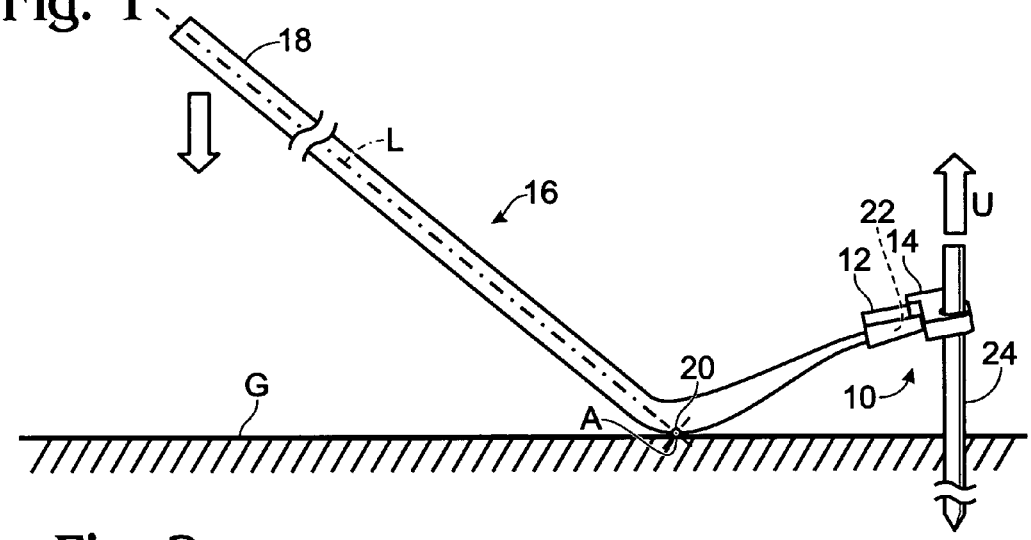
FIG. 1 is a side view of a stake puller in accordance with an embodiment of the present invention, functionally attached to a pry bar.
Figure 2:
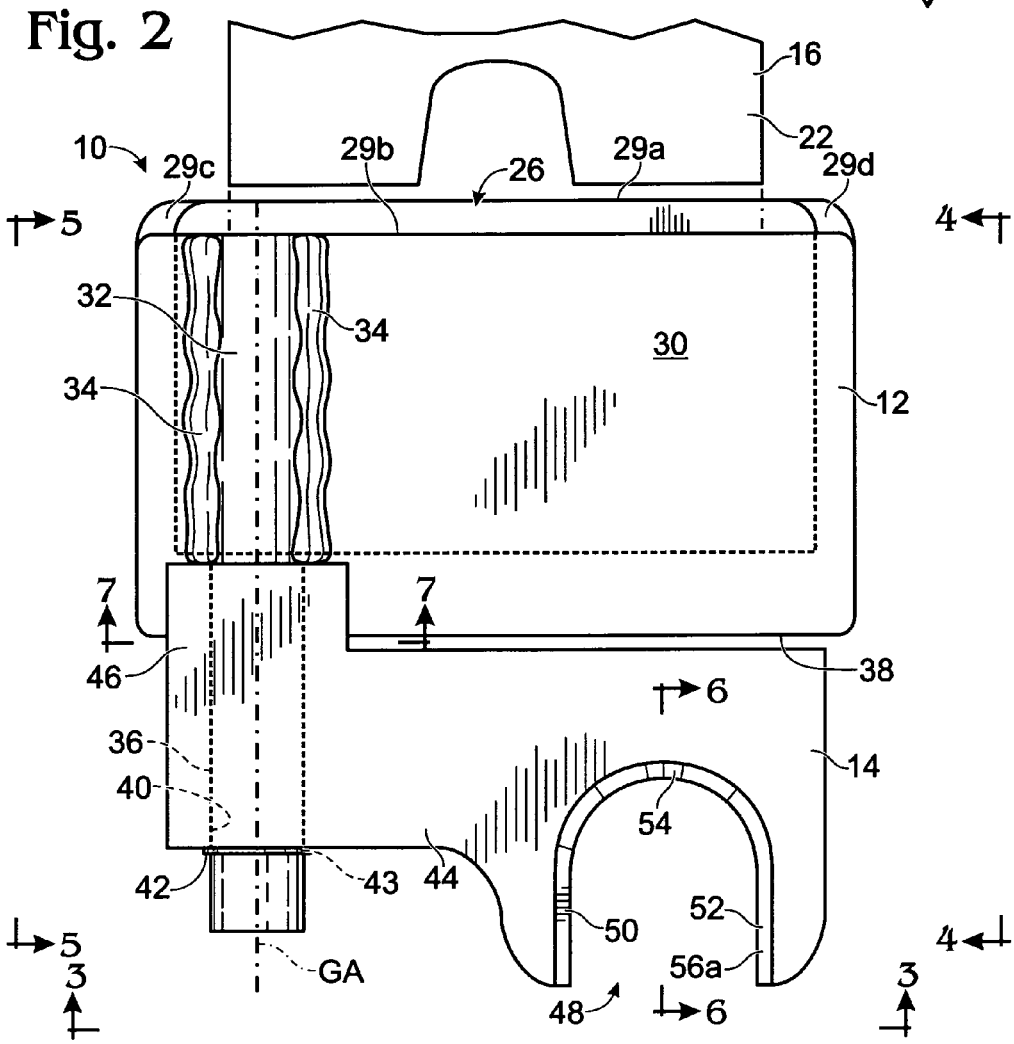
FIG. 2 is a top plan view of a stake puller with a pry bar to which it can be attached in accordance with an embodiment of the present invention, showing a coupler, a post mounted on the coupler, a grip pivotally mounted on the post, a C-shaped ring holding the grip on the post, and a U-shaped slot formed on a forward edge of the grip.

As shown in FIG. 1, a stake puller according to an embodiment of the present invention is indicated generally at 10. Stake puller 10 includes a coupling portion 12 and a grip 14. Coupling portion 12 preferably is used to attach stake puller 10 to a pry bar 16 in a releasable friction fit or other suitable manner. Alternatively, the stake puller may be constructed as a single device, including the pry bar. A typical pry bar includes, as also shown in FIG. 1, a long handle 18, a fulcrum 20, and a wedge-shaped tip 22. The pry bar in use is placed on the ground G adjacent a stake 24 and the pry bar is rotatable about an axis A generally coincident with fulcrum 20. Axis A is generally transverse a long axis L of the pry bar. Coupler 12 and grip 14 are typically made of metal of suitable strength or other appropriate materials, such as 4140 stainless steel hardened to 48 HRC.

Referring now to FIGS. 2–7, coupler 12 may include a rear open end 26 for receiving tip 22 of pry bar 16 in a wedge-shaped inner cavity 28. Rear open end 26 typically includes lower rear edge 29*a*, upper rear edge 29*b*, and side rear edges 29*c* and 29*d*. Preferably, lower rear edge 29*a* extends further rearward than upper rear edge 29*b* in order to aid the insertion of tip 22 of pry bar 16.

Coupler 12 may include an upper surface 30 to which a grip mount, such as post 32, is fixedly mounted, e.g., by welds 34. Alternatively, post 32 may be removably mounted, or formed integrally as part of coupler 12 or mounted by any other suitable means. Post 32 typically includes a forward portion 36 extending forward of a front edge 38 of coupler 12.

Grip 14 may be mounted to forward portion 36 of post 32 by a channel 40, which may be bored through grip 14 with an inner diameter sized to receive post 32 therein, allowing grip 14 to rotate about an axis GA generally defined by post 32. Axis GA is typically substantially perpendicular to the rotational axis A (the fulcrum axis) of the pry bar. A clamp 42, fixed near the end of post 32 in a suitable manner, retains grip 14 on post 32. In the illustrated embodiment, clamp 42 is a thin C-shaped clamp frictionally inserted into a groove 43 formed into post 32. Clamp 42 may be removable in order to remove grip 14 from post 32 in the case that grip 14 becomes damaged, or if the operator desires to install a grip 14 more suitable to pull a particular type of stake.

Figure 8:
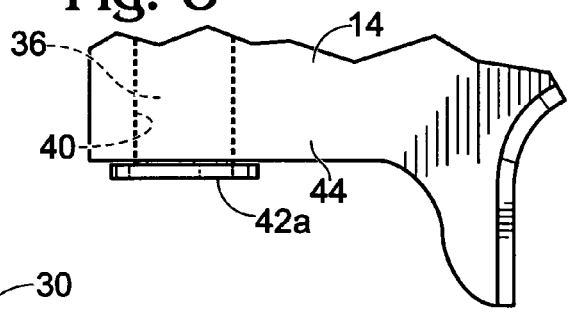
FIG. 8 is a partial top plan view of the grip and post, showing an alternate method of attaching the grip to the post.

An alternative method to retain grip 14 on post 32, as shown in FIG. 8 would include fixing a cap 42*a* on the end of post 32 in a suitable manner, such as by welding. Cap 42*a* may also provide a striking point for a hammer to drive the coupler on the pry bar for a secure, yet removable attachment. Cap 42*a* is preferably a domed rivet, or alternatively may be a metal washer between about 1/16-inch and about 1/4-inch thick or other suitable part for retaining the grip on the post.

Grip 14 may include a body 44 extending out from a connecting portion 46, through which channel 40 extends. The body and connecting portion may be machined from a single piece of material, or may be welded together or assembled in any suitable manner. Body 44 includes a slot for receiving stake 24, preferably a U-shaped slot 48 defined by first side or tooth 50 and a second side or tooth 52 interconnected by a semi-circular bight 54. Slot 48 may be in a C-shape, or alternatively, any suitable shape for grasping the stake, as will be described below.

Slot 48 may include an upper beveled edge 56*a* and a lower beveled edge 56*b*. Upper beveled edge 56*a* and lower beveled edge 56*b* may each continuously traverse the entirety of slot 48. Alternatively either upper beveled edge 56*a* or lower beveled edge 56*b* may each traverse only a portion of slot 48. Preferably, upper beveled edge 56*a* will traverse at least side 50 of slot 48 and lower beveled edge 56*b* will traverse at least side 52 of slot 48.

Figure 6:
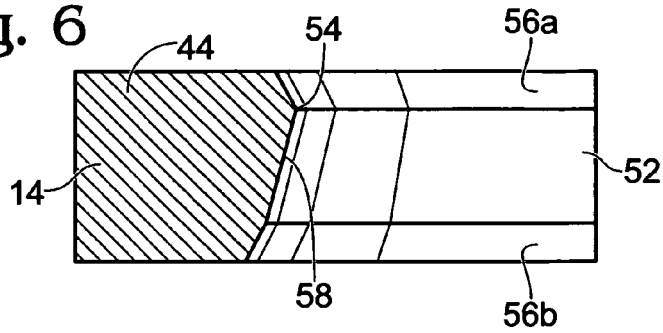
FIG. 6 is a cross-sectional view of the grip's slot, showing the beveled and sloped edges.

Slot 48 may also include a lower sloped edge 58 in bight 54. Lower sloped edge 58 may extend either through a portion of the thickness of bight 54, or through the entire thickness of bight 54, as shown in FIG. 6. In the case where slot 48 includes upper beveled edge 56*a*, lower sloped edge 58 may extend either through a portion of the thickness of bight 54, or to upper beveled edge 56*a*.

Figure 3:
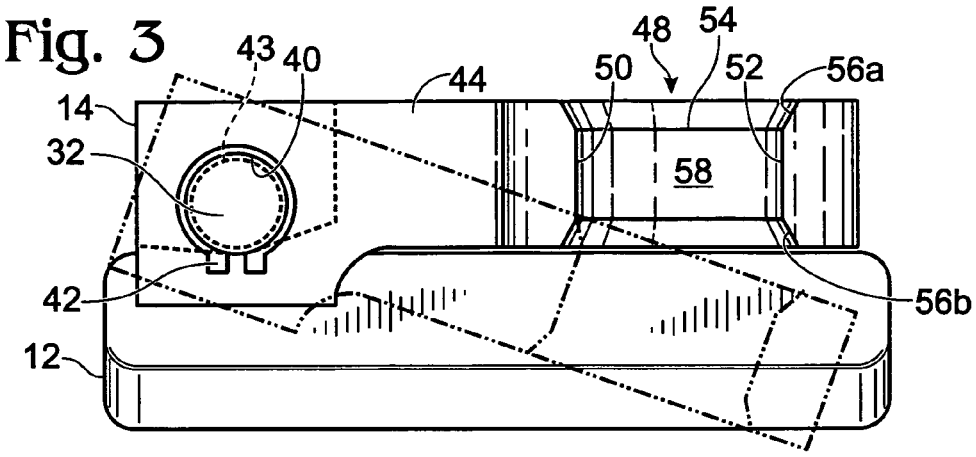
FIG. 3 is a front elevation view of the stake puller of FIG. 2 showing the grip in a nominal position, and in dashed lines, in a lower rotated position.
Figure 4:
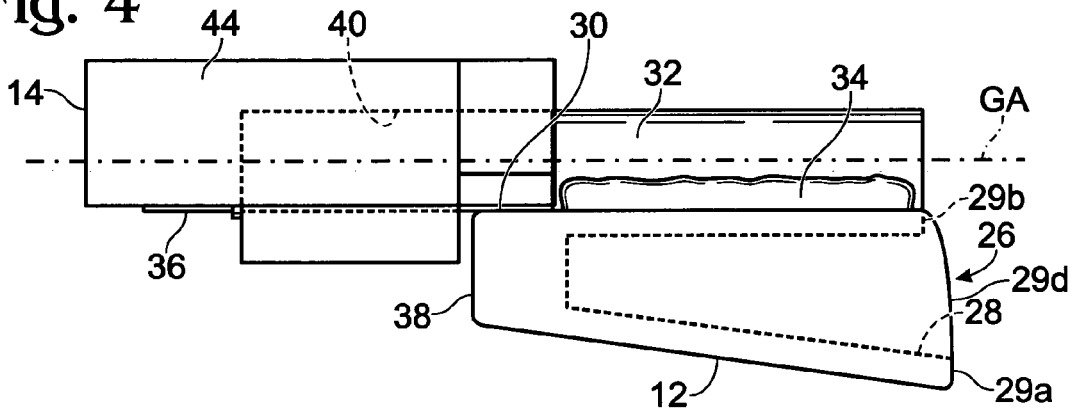
FIG. 4 is a right side elevation view of the stake puller of FIG. 2 showing the coupler having a wedge shape with an inner wedge-shaped cavity, in dashed lines, for receiving the wedge-shaped tip of a pry bar.
Figure 5:
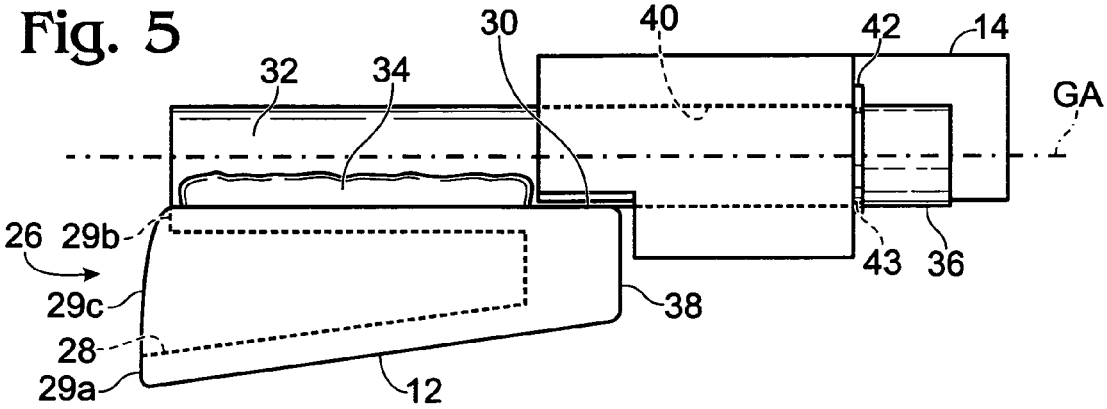
FIG. 5 is a left side elevation view of the stake puller of FIG. 2 showing the coupler and grip and an upper stop for the rotation of the grip.

Grip 14 may be freely rotatable about post 32, but typically the rotation is limited by a lower stop to a lower position shown in FIG. 3 which is about 20-degrees below a level position. The angle for the lower stop is generally chosen for convenient operation of the stake puller consistent with allowing enough rotation for the grip to grab the stake, as will be discussed further below, but not so much rotation as to require the operator to position the grip with one hand while attaching it to a stake. The stake puller as shown can be coupled to the stake while the operator holds only the pry bar with both hands for efficient operation. The rotation of the grip relative to the coupler is limited in the preferred embodiment by edges machined into connecting portion 46 butting against the top surface 30 of coupler 12, but any suitable construction providing the relative rotation limitation may be used.

Figure 7:
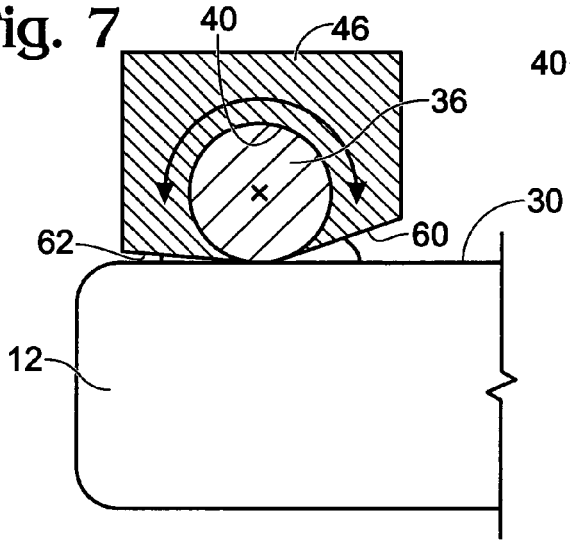
FIG. 7 is a cross-sectional view of the grip and post, showing the upper and lower stops on the grip connecting portion.

A lower stop 60 may be provided on connecting portion 46, as shown in FIG. 7. As grip 14 rotates about post 32, lower stop 60 contacts upper surface 30 of coupler 12, limiting the rotation of the grip. An upper stop 62 may be provided on connecting portion 46 to limit the upper rotation of the grip. Upper stop 62 allows a ratcheting operation of grip 14 by limiting the rotation of the grip as the grip is moved back down the stake after an upward-pulling motion is executed.

The operator of the stake puller will insert the wedge shaped tip 22 of pry bar 16 into wedge-shaped cavity 28 of coupler 12. The extension of lower rear edge 29*a* beyond upper rear edge 29*b* allows the operator to insert pry bar 16 into coupler 12 with needing to hold stake puller 10 in one hand and pry bar 16 in the other.

Figure 9:
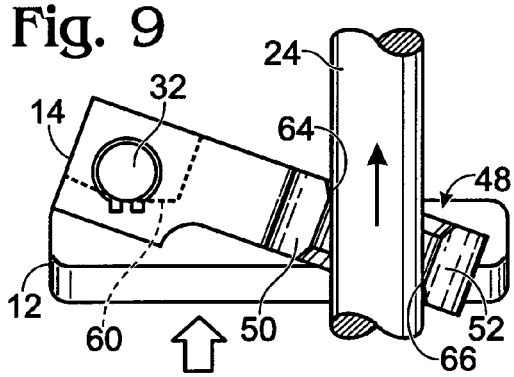
FIG. 9 shows the stake puller in operation with an upper edge of the left-hand side of the grip's slot and a lower edge of the right-hand side of the grip's slot grabbing hold of the stake and urging it upward.
Figure 10:
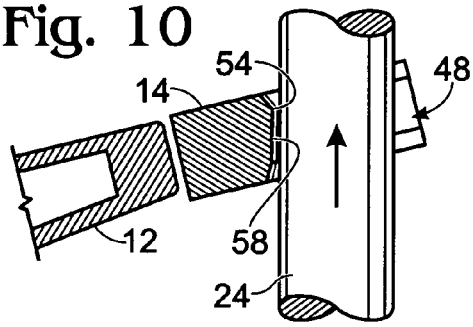
FIG. 10 is a partially cutaway side view of the stake puller in an upwardly-moved position, showing the stake in a beveled recess in the grip's slot.
Figure 11:
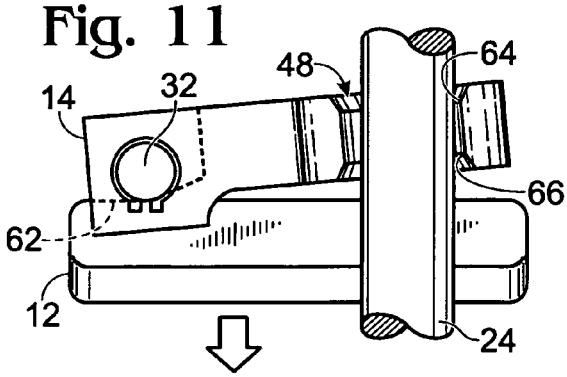
FIG. 11 shows the stake puller during a reverse stroke of operation, showing the grip rotated to a position where it is able to slide down the stake without grabbing the stake.

Operation of the stake puller to draw stake 24 out of the ground is shown in FIGS. 9–11. Slot 48 is typically sized slightly wider than the stake desired to be pulled. The operator places the pry bar, with the stake puller attached, on the ground on the fulcrum point and slides the bar forward. With grip 14 rotated to lower stop 60, upper beveled edge 56*a* on side 50 of slot 48 and lower beveled edge 56*b* on side 52 of slot 48 provide more clearance for stake 24 to be inserted into slot 48. The operator pushes the pry bar forward until stake 24 is fully within the slot and is pressed against bight 54 of slot 48.

Then the operator presses the pry bar handle down, rotating the bar at the fulcrum point about axis A, and causing grip 14 to move upward. As grip 14 is lifted, it rotates about axis GA until an upper edge 64 of side 50 and a lower edge 66 of side 52 contact the wall of stake 24. Initial friction between upper edge 64 tends to cause the grip to rotate upwards which tightens edges 64 and 66 onto stake 24 until the stake is firmly grabbed between the edges, as depicted in FIG. 9. Then as the pry bar is further rotated, the stake is pulled upwardly as shown by arrow U. As grip 14 rotates upwards, beveled edges 56*a* and 56*b* provide more surface contact with, and less damage to, stake 24, as the stake is removed. Sloped edge 58 in bight 54 provides a recess into which stake 24 is partially received as grip 14 moves upward, as shown in FIG. 10. Sloped edge 58 prevents the stake from being pushed out of slot 48 and helps maintain the grasp of the grip on the stake.

When the operator reaches a maximum deflection of the pry bar, the pry bar handle is raised up again to prepare for another pulling operation on the stake. As the handle goes up, grip 14 moves down on stake 24, which pushes lower edge 66 upwardly, causing grip 14 to rotate back toward a level position. This allows the grip to be easily moved back down. However, the rotation of grip 14 is limited by upper stop 62, so that grip 14 will not grab stake 24 as the grip is moved down, as shown in FIG. 11. This provides the ratcheting feature of the stake removal as mentioned above. Upper stop typically limits rotation of grip 14 to no more than about 5-degrees above level. These operations are repeated until the stake has been suitably pulled out of the ground.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An attachment for a pry bar for pulling up a stake, the pry bar configured to rotate about a substantially horizontal axis to pull up the stake, the attachment comprising:

a coupler attachable to the pry bar; and a grip pivotally connected to the coupler on an axis substantially perpendicular to the rotational axis of the pry bar, the grip being adapted to releasably attach to the stake, and further comprising a lower stop for the pivotal connection between the coupler and the grip that limits the rotation of the grip below a level position.

2. The pry bar attachment of claim 1, wherein the lower stop is formed as an edge disposed on the connecting portion that contacts the top surface of the coupler as the grip is rotated on the post.

3. The pry bar attachment of claim 1, wherein the lower stop limits the rotation to no more than about 20 degrees of rotation below the level position.

4. The pry bar attachment of claim 1 wherein the grip includes a slot adapted to grip the stake as the pry bar is raised and the grip rotates on its pivotal connection.

5. The pry bar attachment of claim 4, wherein the grip includes a forward edge and the slot opens on the forward edge.

6. The pry bar attachment of claim 5, wherein the slot is a substantially U-shaped slot including two teeth that are interconnected by a semicircular bight, the teeth providing the arms of the U-shape and being teeth spaced apart to receive the stake therebetween, the teeth gripping the stake as the pry bar is raised and the grip rotates on its pivotal connection.

7. The pry bar attachment of claim 6 wherein the grip further includes a lower sloped edge in the bight of the U-shaped slot.

8. The pry bar attachment of claim 6, wherein the grip further includes an upper beveled edge in the U-shaped slot.

9. The pry bar attachment of claim 8, wherein the grip further includes a lower sloped edge in the bight of the U-shaped slot, the lower sloped edge extending substantially up to the upper bevel.

10. The pry bar attachment of claim 6, wherein the grip further includes a lower beveled edge in the U-shaped slot.

11. The pry bar attachment of claim 1, wherein the coupler includes an enclosure and an inner cavity, the enclosure having an opening adapted for insertion of the pry bar into the inner cavity.

12. The pry bar attachment of claim 11, wherein the enclosure includes an upper rear edge and a lower rear edge, wherein the lower rear edge extends further rearward than the upper edge.

13. The pry bar attachment of claim 11, wherein the enclosure is shaped to receive a wedge.

14. The pry bar attachment of claim 11, wherein the inner cavity is adapted to frictionally attach the coupler to the pry bar.

15. The pry bar attachment of claim 14, wherein an elastomeric o-ring is disposed within the inner cavity to frictionally attach the coupler to the pry bar.

16. The pry bar attachment of claim 1, wherein the coupler is fixedly attachable to the pry bar.

17. An attachment for a pry bar for pulling up a stake, the pry bar configured to rotate about a substantially horizontal axis to pull up the stake, the attachment comprising:

a coupler attachable to the pry bar; and a grip pivotally connected to the coupler on an axis substantially perpendicular to the rotational axis of the pry bar, the grip being adapted to releasably attach to the stake and further comprising:

a post fixedly attached to a top surface of the coupler and extending beyond a forward edge of the coupler; and a connecting portion formed integral to the grip, wherein the connecting portion has a channel through which the post is inserted to provide the pivotal connection between the grip and the coupler; and a removable clamp for retaining the connecting portion on the post, wherein the clamp is a C-shaped ring inserted into a groove that is formed in the post.

18. The pry bar attachment of claim 17, further comprising a cap for retaining the connecting portion on the post, wherein the cap is a domed rivet.

19. The pry bar attachment of claim 17, further comprising a cap for retaining the connecting portion on the post, wherein the cap is a flat washer between about 1/16" and about 1/4" in thickness.

20. An attachment for a pry bar for pulling up a stake, the pry bar configured to rotate about a substantially horizontal axis to pull up the stake, the attachment comprising:

a coupler attachable to the pry bar; and a grip pivotally connected to the coupler on an axis substantially perpendicular to the rotational axis of the pry bar, the grip being adapted to releasably attach to the stake, and further comprising an upper stop for the pivotal connection between the coupler and the grip that limits the rotation of the grip above a level position.

21. The pry bar attachment of claim 20, wherein the upper stop is formed as an edge disposed on the connecting portion that contacts the top surface of the coupler as the grip is rotated on the post.

22. The pry bar attachment of claim 20, wherein the upper stop limits the rotation to no more than about 5 degrees of rotation above the level position.

* * * * *